US005429532A

United States Patent [19]

Auclair, John W.

[11] Patent Number: 5,429,532

[45] Date of Patent: Jul. 4, 1995

[54] CABLE SHIELD GROUND CLAMP

[75] Inventor: Auclair, John W., Canaan, Conn.

[73] Assignee: Electric Motion Company, Inc., Winsted, Conn.

[21] Appl. No.: 58,159

[22] Filed: May 5, 1993

[51] Int. Cl.[6] ..... H01R 13/648

[52] U.S. Cl. ..... 439/793; 439/812; 439/98

[58] Field of Search ..... 439/793, 98, 100, 810, 439/814, 811, 812; 24/135 N, 135 R

[56] References Cited

U.S. PATENT DOCUMENTS

| | | | |
|---|---|---|---|
| 2,006,794 | 7/1935 | Davidson | 439/812 |
| 2,088,481 | 7/1937 | Mylius | 439/812 |
| 2,693,587 | 11/1954 | Davidson | 439/812 |
| 2,812,963 | 11/1957 | Johansson | 439/793 |
| 3,544,955 | 12/1970 | Ruiz | 24/135 N |
| 4,257,658 | 3/1981 | Hammond et al. | 439/98 |
| 4,623,205 | 11/1986 | Barron | 439/96 |
| 4,639,056 | 1/1987 | Lindeman et al. | 439/79 |
| 4,646,395 | 3/1987 | Mayszak | 24/135 R |
| 4,842,530 | 6/1989 | Erickson, II et al. | 439/98 |
| 5,021,014 | 6/1991 | Walter et al. | 439/812 |

FOREIGN PATENT DOCUMENTS

| | | | |
|---|---|---|---|
| 525849 | 6/1956 | Canada | 439/793 |
| 895016 | 10/1953 | Germany | 439/793 |

*Primary Examiner*—Gary F. Paumen

*Attorney, Agent, or Firm*—Chilton, Alix & Van Kirk

[57] ABSTRACT

A ground clamp for clamping to a cable shield to provide a ground connection employs a U-shaped yoke. A keeper threadably engages thread surfaces at the interior side of the yoke legs. The keeper has a clamp jaw which may be compressively engaged against a cable shield received in an aperture defined by the yoke. The yoke then connects to a common ground point via a flexible ground wire connection.

17 Claims, 3 Drawing Sheets

CABLE SHIELD GROUND CLAMP

BACKGROUND OF THE INVENTION

This invention relates generally to devices for implementing a ground connection between a metallic shield of a cable and a common ground point. More particularly, the present invention relates generally to clamp devices which mount to service cables and connect via a flexible conductor with a common ground point.

A number of various types of devices have been employed for connecting a ground wire with the tubular ground shields of buried service wires. Most conventional devices employ clamp assemblies of various forms. A number of conventional clamp assemblies can accommodate more than one service wire. In applications to which the present invention relates, the connecting devices are ordinarily positioned within a cabinet, housing or other enclosure, hereafter collectively termed "enclosure", to provide a grounding connection between the metallic shield of the service cable and a common ground point. Frequently, there is a minimal amount of available space within the enclosures for such ground connecting devices.

A number of conventional designs are configured to mount rigidly or semi-rigidly within the enclosures. For such designs, damage to the cables can occur when the enclosure is subject to intense environmental changes and the cables are fixedly positioned in the ground. For example, it is not uncommon for the enclosure to heave as a result of frost while the service cables are frozen in position in the ground.

U.S. Pat. No. 4,646,395 discloses one type of cable clamp to which the present invention generally relates. The clamp has a stamped metal body portion with two end walls that extend at right angles to the base. A pair of arms spaced intermediate along one edge of the base extend outwardly at essentially right angles to the base such that they are parallel to the end walls. An arm and an associated end wall form channels. A moveable jaw interfits below the arms. The jaw is tightenable into compressive engagement with the cables which are received in the channels.

SUMMARY OF THE INVENTION

Briefly stated, the invention in a preferred form is a cable shield ground clamp for connecting a service cable shield with a flexible ground conductor. The clamp assembly comprises a generally U-shaped yoke which defines a service cable receiving aperture. The legs of the yoke have opposed thread surfaces. A keeper is threadable with the thread surfaces of the yoke and torquable for displacement relative to the yoke. The keeper includes a clamp jaw which is compressively engageable against a service wire ground shield received in the aperture. The yoke includes a set screw or other means for connecting the yoke with a flexible ground wire or other ground connection. The keeper has a rotatably mounted threaded driver which engages with the yoke. A slot in the bottom of the driver facilitates the threadable displacement of the keeper to implement the clamp connection. The keeper jaw, in one embodiment, has a V-shaped recess for intimately engaging the ground shield. The keeper also has a pair of skirts which define opposed openings through which the legs of the yoke are received. The yoke legs further have opposed indentations which facilitate the severing and removal of end segments of the legs to better accommodate enclosure headroom constraints for a given application.

An object of the invention is to provide a new and improved cable shield ground clamp for implementing a ground connection between the metallic shield of a service cable and a common ground point.

Another object of the invention is to provide a new and improved cable shield ground clamp which has an efficient compact construction.

A further object of the invention is to provide a new and improved cable shield ground clamp which can be efficiently disassembled in the field to allow for isolation of one or more service cables.

A yet further object of the invention is to provide a new and improved cable shield ground clamp which in a single specimen can efficiently bond with one or a multiplicity of service wires.

Other objects and advantages of the invention will become apparent from the specification and the drawings.

DETAILED DESCRIPTION OF THE PREFERRED EMBODIMENT

Figure 1:
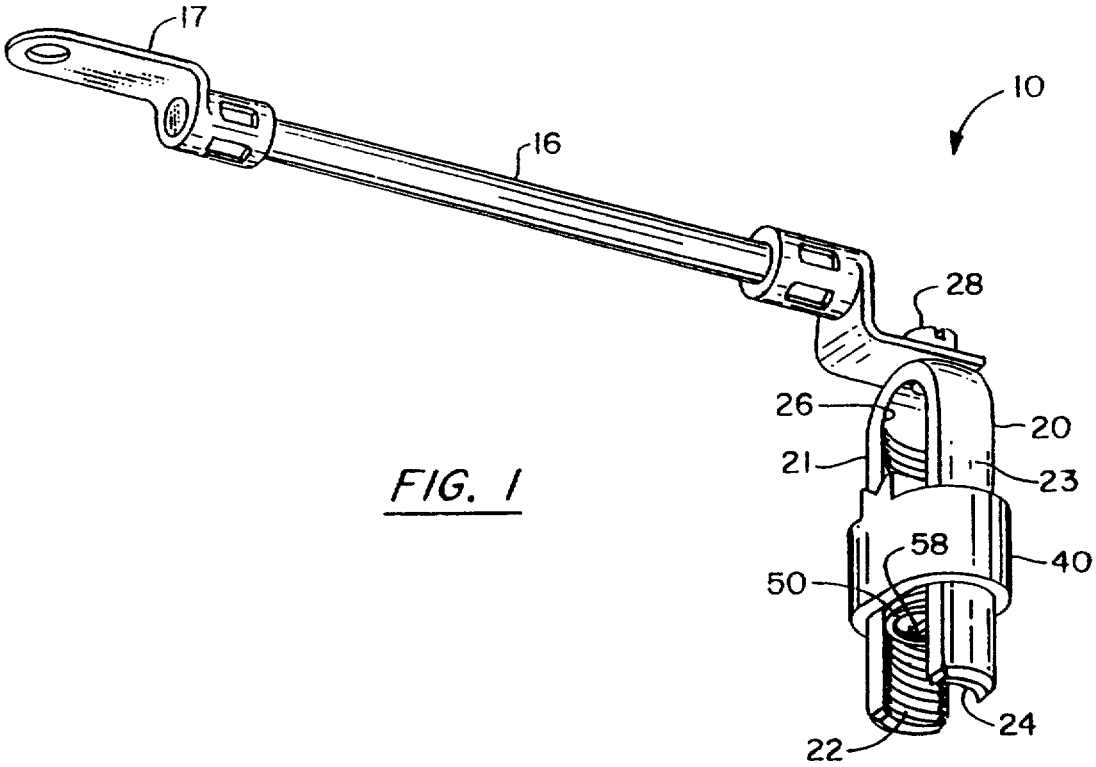
FIG. 1 is a perspective view of a cable shield ground clamp in accordance with the present invention, illustrated in conjunction with a ground wire.
Figure 2:
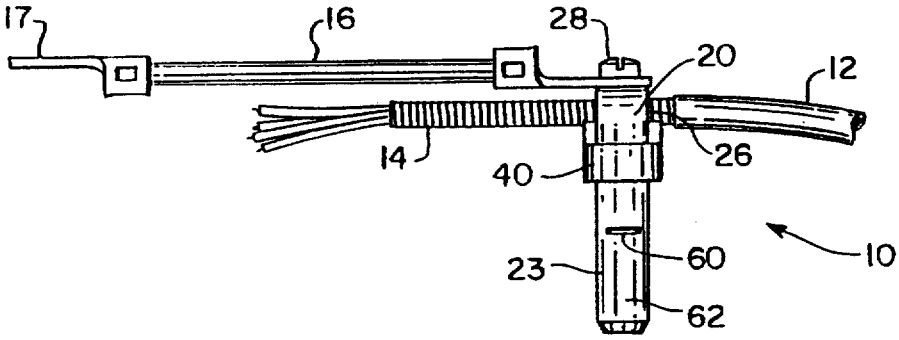
FIG. 2 is a side elevational view of the cable shield ground clamp and ground wire of FIG. 1 together with a service wire.

With reference to the drawings wherein like numerals represent like parts throughout the Figures, a cable shield ground clamp in accordance with the present invention is generally designated by the numeral 10. The clamp 10 is particularly adapted for receiving one or more service wires 12 and connecting the tubular metallic shields 14 of the wires to a common ground point. Preferably, the ground connection is provided by a flexible wire 16, ribbon conductor 18 (FIG. 7), or other conventional grounding connector (not illustrated). The cable shield ground clamp 10 is adapted for use in an enclosure, such as a cabinet or other housing, to provide a flexible connection which allows the buried service wire cables and the enclosure to move independently of each other when frost or other environmental forces result in relative disparate displacement.

The cable shield ground clamp 10 comprises a generally U-shaped yoke 20 having generally parallel legs 21 and 23. The legs 21 and 23 of the yoke have respective opposed inwardly disposed thread surfaces 22 and 24. A receiving aperture 26 is generally formed at the upper inward portion of the yoke for receiving one or more service wire ground shields 14. A set screw 28, which may be any of numerous conventional forms, is threaded at the upper cap of the yoke for anchoring the flexible ground wire 16, the ribbon connector 18 or other suitable grounding connector (not illustrated). Ground wire 16 is typically a six inch #6 or #10 AWG lead wire and the wire terminal 17 is connected to a ground stud (not illustrated) in the enclosure.

Figure 6:
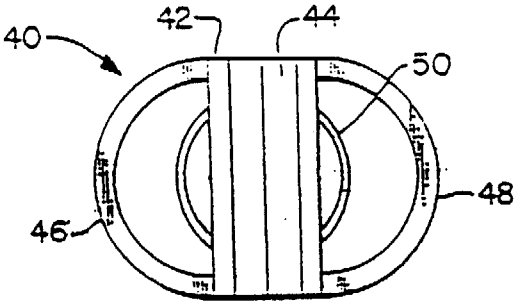
FIG. 6 is a top plan view of the keeper of FIG. 4.
Figure 4:
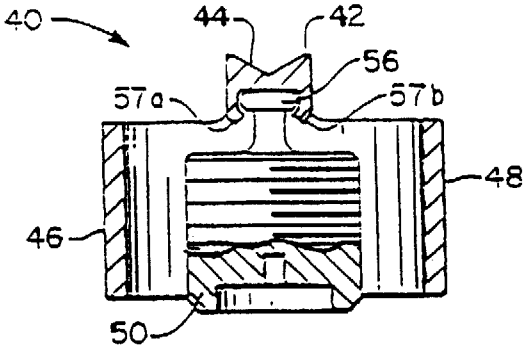
FIG. 4 is a frontal sectional view of the keeper for the cable shield ground clamp of FIG. 1.
Figure 5:
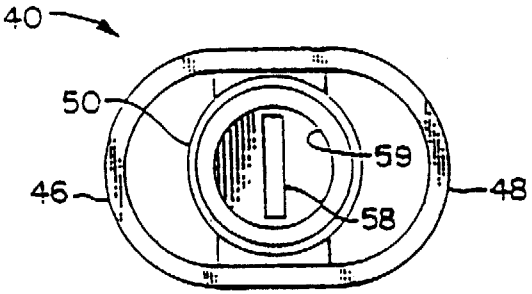
FIG. 5 is a bottom view of the keeper of FIG. 4.

The ground shields 14 are compressively secured to the clamp by means of a keeper 40 which is slidably displaceable and selectively fixedly positionable along the legs of the yoke. With additional reference to FIGS. 4–6, the keeper 40 includes an upper clamp jaw 42 which in a preferred form has a laterally extending V-shaped recess or groove 44. The groove 44 enhances surface contact with the ground shield and provides a more intimate clamping engagement. The body of the keeper includes a pair of integral guide skirts 46 and 48. The guide skirts 46 and 48 form axial openings (FIGS. 5 and 6) which are dimensioned to be greater than the sections of the legs of the yoke to permit sliding displacement relative thereto. The guide skirts 46 and 48 also function to limit lateral separation between the legs of the yoke which are generally parallel regardless of the position of the keeper. The yoke 20 and keeper 40 typically have a tin plated brass composition or a zinc with copper/tin plated composition.

The position and displacement of the keeper 40 is governed by a threaded driver 50. The threaded driver 50 is rotatably mounted at the underside of the clamp jaw 42. The driver 50 has a helical threaded surface which is dimensioned for threading engagement with the complementary thread surfaces 22 and 24 of the yoke. In the illustrated embodiment, the driver 50 includes a knob-like neck 56 (FIG. 4) which is inserted into an opening at the underside of the jaw. The jaw sides are then transversely crimped at locations 57*a* and 57*b* to retain the driver with the keeper while allowing the driver to rotate relative to the jaw. Alternate driver mounting means are also possible. The underside of the driver includes a recessed slot 58 which is dimensioned to receive a blade of a screwdriver or similar tool for torquing the driver. The recess walls 59 retain the blade as it rotates. Alternately, the slot 58 may not be recessed. The driver threadably engages the surfaces 22 and 24 of the yoke and is threadably displaceable along the legs of the yoke for selectively compressively clamping the jaw 42 against a received ground shield 14. The clamp engagement with the ground shield is maintained by the threaded engagement between the driver and the yoke which is also laterally reinforced by the guide skirts 46 and 48.

Figure 3:
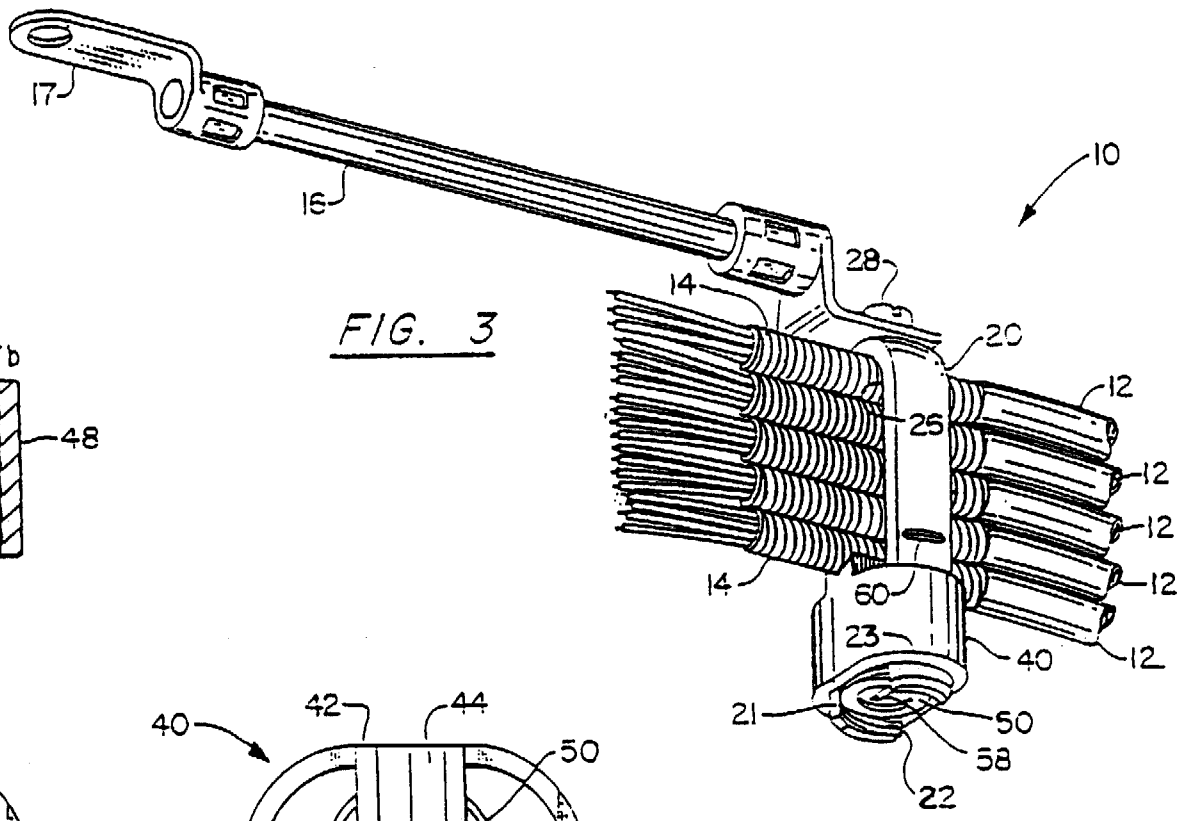
FIG. 3 is a perspective view of the cable shield ground clamp and ground wire of FIG. 1 together with multiple service wires.

Because of the variable displacement of the keeper 40 and the dimensions of the legs 21 and 23, the receiving aperture 26 is dimensioned to receive and clamp one or more ground shields in generally parallel adjacent relationship, as best illustrated in FIG. 3. The outer surface of the yoke legs are traversed by generally aligned indentations 60 (not visible in FIG. 1). The indentations 60 function to allow the unneeded distal portions of the yoke to be snapped off and removed with pliers, thereby resulting in a more compact assembly. For example, if one or a small number of ground shields are connected for a given application, the latter breakaway design allows the installer at the installation site to remove the extreme leg segments 62 of the yoke when the variable aperture 26 dimension required is relatively small to thereby provide a more compact assembly.

Figure 7:
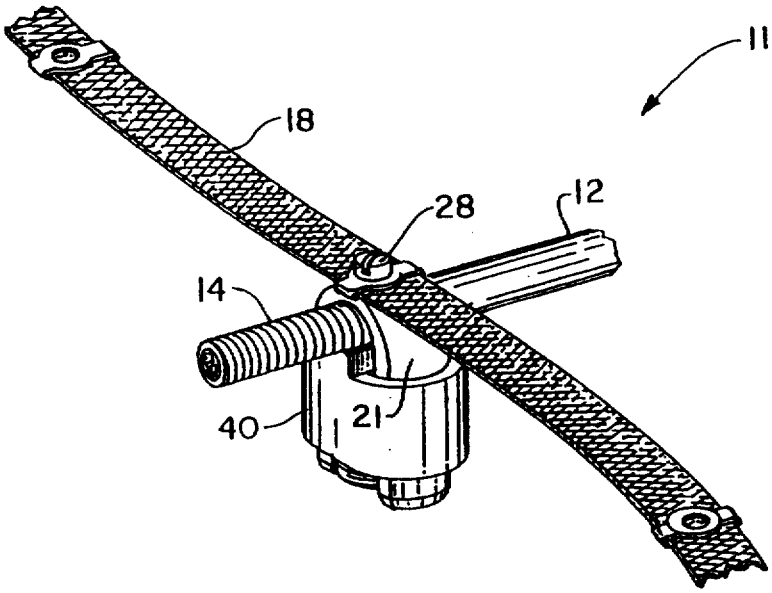
FIG. 7 is a top perspective view of an alternate embodiment of a cable shield ground clamp together with a ribbon ground conductor and a service cable.

The ground clamp 11 illustrated in FIG. 7 is similar to clamp 10 except that the yoke 21 is dimensioned for one cable shield and accordingly the legs of the yoke 21 are truncated in relation to legs 21 and 23 of yoke 20. The yoke 21 also does not have the optional indentations 60.

The open ended design for clamps 10 and 11 allows the keeper 40 to be completely dismounted from the yoke 20 or 21 so that the clamp 10 may be installed onto a wire which is already in service. In addition, the clamp may be disassembled, i.e., the keeper 40 disengaged from the yoke 20, to isolate the ground.

The ground clamps 10 and 11 have particular applicability for buried service wires. The service wires are connected by initially exposing approximately one inch of the ground shield. The service wire and ground shield are inserted into the receiving aperture. The keeper jaw 42 is compressively tightened against the shield upon insertion of a screwdriver blade into the slot 58 and torquing the screwdriver. The wire terminal 17 of ground wire 16 or ribbon conductor 18 is then installed onto an appropriate ground stud (not illustrated) within the enclosure. If appropriate the extreme leg segment 62 of the yoke may be removed. It should be appreciated that a single clamp 10 may be employed to connect either one or several service wires. The connection may be accomplished while also providing a compact configuration.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is

1. A cable shield ground clamp comprising:

a generally U-shaped yoke having a pair of legs terminating in free ends and connected by a bight portion and defining a receiving aperture, said legs having opposed interior thread surfaces which extend substantially to said free ends of said legs opposite said bight portion;

keeper means mounted to said yoke, said keeper means comprising a clamp jaw disposed between said legs, said keeper means being threadably engageable with said yoke thread surfaces for variable positioning therealong and for maintaining the position of said clamp jaw at a selected fixed position relative to said yoke wherein said opposed leg thread surfaces support said keeper thread surfaces, said keeper means further comprising a pair of guide skirts which at least partially surround said yoke legs to prevent separation therebetween;

ground connection means for connecting said yoke with a ground connector; and indentation means for facilitating removal of distal end portions of said yoke legs comprising a pair of laterally extending indentations on said yoke legs, said indentation means being positioned intermediate said yoke leg free ends and said bight portion.

2. The cable shield clamp of claim 1 wherein said keeper means further comprises a driver having a helical threaded surface, said driver threaded surface being engageable with said yoke thread surface and being rotatable relative to said clamp jaw.

3. The cable shield clamp of claim 2 wherein said driver further defines a slot.

4. The cable shield clamp of claim 3 wherein said driver further comprises recess means for defining a recess and said slot opens into said recess.

5. The cable shield clamp of claim 1 wherein said jaw comprises a platform portion, said platform portion defining a transverse V-shaped recess.

6. The cable shield clamp of claim 1 wherein said keeper means further comprises a pair of guide skirts which surround said yoke legs.

7. The cable shield clamp of claim 1 wherein said cable means further comprises a rotatable driver and said jaw has an engagement surface and a generally opposite underside, said driver being rotatably mounted to the underside of said clamp jaw.

8. The cable shield clamp of claim 1 wherein said ground connection means comprises a set screw threaded to said bight portion.

9. A cable shield ground clamp comprising:

a generally U-shaped yoke having a pair of legs terminating in free ends and connected by a bight portion and defining an aperture for receiving at least one cable shield, said legs having opposed interior thread surfaces which extend substantially to said free ends of said legs opposite said bight portion;

keeper means mounted to said yoke, said keeper means comprising clamp means disposed between said legs and compressively engageable against a said cable shield, said keeper means comprising positioner means threadably engageable with said yoke thread surfaces for variably positioning said clamp means along said legs and maintaining said clamp means at a fixed position on said yoke wherein said opposed leg thread surfaces support said keeper thread surfaces, said keeper means further comprising a pair of guide skirts which at least partially surround said yoke legs to prevent separation therebetween;

ground connection means for connecting said yoke with a ground connector; and indentation means for facilitating removal of distal end portions of said yoke legs comprising a pair of indentations on said yoke legs.

10. The cable shield clamp of claim 9 wherein said positioner means comprises a driver having first and second axial spaced ends and a helical threaded surface, said driver being rotable about said axis relative to said clamp means.

11. The cable shield clamp of claim 10 wherein said driver at said first end further comprises mounting means for rotatably mounting to said clamp means and further defines a slot adjacent said second end.

12. The cable shield clamp of claim 11 wherein said driver further comprises recess means for defining an axial recess and said slot opens into said recess.

13. The cable shield clamp of claim 9 wherein said clamp means comprises a platform portion, said platform portion defining a transverse V-shaped recess.

14. The cable shield clamp of claim 9 wherein said keeper means further comprises a pair of laterally spaced guide members which slidably engage against said yoke legs.

15. A cable shield ground clamp comprising:

a generally U-shaped yoke having a pair of generally parallel legs and defining an aperture for receiving at least one cable shield, said legs having opposed thread surfaces;

keeper means mounted to said yoke, said keeper means comprising guide means for slidably receiving said legs, said guide means comprising a pair of skirts at least partially surrounding said legs and said keeper means further comprising a clamp jaw disposed between said legs, said keeper means being threadably engageable with said yoke thread surfaces for variable positioning therealong and for compressively engaging a said cable shield disposed in said aperture wherein said opposed leg thread surfaces support said keeper surface;

ground connection means for connecting said yoke with a ground connector; and removal means for facilitating removal of distal end portions of said legs comprising a pair of indentations on said legs.

16. The cable shield clamp of claim 15 wherein said keeper means further comprises a driver having a helical threaded surface, said driver threaded surface being engageable with said yoke thread surface and being rotatable relative to said clamp jaw.

17. The cable shield clamp of claim 16 wherein said driver further comprises means for receiving an applied torque.

* * * * *